US008781351B2

(12) United States Patent
Falvo et al.

(10) Patent No.: US 8,781,351 B2
(45) Date of Patent: Jul. 15, 2014

(54) METHOD FOR ASSESSING TRANSFER PRESSURE UNIFORMITY

(75) Inventors: John R. Falvo, Ontario, NY (US); Eliud Robles-Flores, Webster, NY (US); Michael Grew, Fairport, NY (US); David B. Montfort, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 706 days.

(21) Appl. No.: 13/046,981

(22) Filed: Mar. 14, 2011

(65) Prior Publication Data

US 2012/0237239 A1 Sep. 20, 2012

(51) Int. Cl.
*G03G 15/16* (2006.01)

(52) U.S. Cl.
USPC ..... 399/66

(58) Field of Classification Search
USPC ..... 399/66, 316
See application file for complete search history.

(56) References Cited

U.S. PATENT DOCUMENTS 8,374,533 B2 * 2/2013 Higgins et al. ..... 399/316

* cited by examiner

*Primary Examiner* — David Gray
*Assistant Examiner* — Erika J Villaluna
(74) *Attorney, Agent, or Firm* — Fay Sharpe LLP

(57) ABSTRACT

Systems and methods are described that facilitate automatically and uniformly depositing a marking material on transfer assist blade (TAB) petals to improve TAB pressure profile accuracy. A TAB liftoff timing value is adjusted in non-volatile memory (NVM) to delay TAB liftoff beyond a trailing edge of a page on which an oversized (in the process direction) image being printed. Toner deposited on a photoreceptor belt beyond the trailing edge of the page is picked up by the TAB petals once the trailing edge of the page has passed the TAB. The TAB is then disengaged and re-engaged against a backside of a next page, where the TAB petals deposit the uniformly acquired toner to generate the TAB pressure profile.

19 Claims, 8 Drawing Sheets

METHOD FOR ASSESSING TRANSFER PRESSURE UNIFORMITY

TECHNICAL FIELD

The present exemplary embodiments broadly relate to transfer assist blade (TAB) calibration for a marking device or printer. However, it is to be appreciated that the present exemplary embodiments are also amenable to other devices and other applications.

BACKGROUND

The process of transferring charged toner particles from an image bearing member marking device (e.g. photoreceptor) to an image support substrate (e.g., sheet) involves overcoming cohesive forces holding the toner particles to the image bearing member. The interface between the photoreceptor surface and image support substrate is not always optimal. Thus, problems may be caused in the transfer process when spaces or gaps exist between the developed image and the image support substrate. A critical aspect of the transfer process is focused on the application and maintenance of high intensity electrostatic fields in the transfer region for overcoming the cohesive forces acting on the toner particles as they rest on the photoreceptive member. Careful control of these electrostatic fields and other forces is required to induce the physical detachment and transfer-over of the charged toner particles without scattering or smearing the developer material. Mechanical devices that force the image support substrate into intimate and substantially uniform contact with the image bearing surface have been incorporated into transfer systems. Various contact blade arrangements have been proposed for sweeping the backside of the image support substrate, with a constant force, at the entrance to the transfer region. Xerographic systems use a transfer assist blade (TAB) to flatten print media onto the photoreceptor to ensure uniform transfer of the toner to the sheet.

A TAB is sometimes used to push the full width of paper sheet against the photoreceptor belt when transferring the toner image to the paper. TAB pressure uniformity along the width of the paper sheet can vary for a variety of reasons. Differing pressure uniformity across the paper width can produce various image artifacts and defects on the document. Currently, there is no automated method of determining TAB pressure uniformity along the width of a paper sheet while the TAB is installed in a machine.

One conventional approach for testing TAB pressure uniformity involves manually dusting the TAB with powdered toner so as to leave a print or "mark" on the backside of a sheet of paper. This enables service personnel to adjust timing.

However, when manually applying toner dust to a TAB, the results typically indicated non-uniform coverage and may provide only one marked sample sheet. Not having uniform toner along the width of the TAB and/or not having a population of marked sheets results in inaccurate and difficult diagnosis of problems.

There is an unmet need in the art for automated TAB timing calibration systems and methods that overcome the above-mentioned deficiencies and others.

BRIEF DESCRIPTION

In one aspect, a method of automating generation of a transfer assist blade (TAB) pressure profile comprises receiving TAB profile generation parameters, the parameters comprising information relating to automatically and uniformly applying toner to a plurality of TAB petals, printing an oversized image on a plurality of pages to generate at least one toner pickup area on a photoreceptor belt in a printing device, and maintaining contact between the TAB petals and the photoreceptor belt beyond a trailing edge of at least a first page, thereby uniformly acquiring toner on the TAB petals. The method further comprises disengaging the TAB petals from the photoreceptor belt at a trailing edge of the oversized image, generating the TAB pressure profile by re-engaging the TAB petals and depositing the uniformly acquired toner on at least a second page as it passes by the TAB, and outputting at least one printed page having the TAB pressure profile deposited thereon.

In another aspect, a system that facilitates automating generation of a transfer assist blade (TAB) pressure profile comprises a printer that comprises a photoreceptor belt and a TAB, and a processor that executes stored computer-executable instructions for receiving TAB profile generation parameters, the parameters comprising information relating to automatically and uniformly applying toner to a plurality of TAB petals, and for printing an oversized image on a plurality of pages to generate at least one toner pickup area on a photoreceptor belt in a printing device. The instructions further comprise maintaining contact between the TAB petals and the photoreceptor belt beyond a trailing edge of at least a first page, thereby uniformly acquiring toner on the TAB petals, disengaging the TAB petals from the photoreceptor belt at a trailing edge of the oversized image, and generating the TAB pressure profile by re-engaging the TAB petals and depositing the uniformly acquired toner on at least a second page as it passes by the TAB. The printer prints the oversized image on the plurality of pages and outputs the plurality of pages with the TAB pressure profile deposited on a backside of at least one of the plurality of pages.

In yet another aspect, a method of automating generation of a transfer assist blade (TAB) pressure profile comprises printing an oversized image on a plurality of pages to generate at least one toner pickup area on a photoreceptor belt in a printing device, and altering a TAB liftoff timing value in a non-volatile memory (NVM) location in which the value is stored to cause petals of the TAB to maintain contact between the with the photoreceptor belt beyond a trailing edge of at least a first page, thereby uniformly acquiring toner on the TAB petals. The method further comprises disengaging the TAB petals from the photoreceptor belt at a trailing edge of the oversized image, re-engaging the TAB on at least a second page and depositing the uniformly acquired toner on at least a second page as it passes by the TAB, and outputting at least one printed page having the TAB pressure profile deposited thereon.

DETAILED DESCRIPTION

The systems and methods described herein can be utilized to determine transfer assist blade (TAB) pressure uniformity by automatically applying powdered toner material onto the TAB blade petals while a machine in which the TAB is installed is printing, thereby allowing the toner material to be transferred from the TAB petals to the backsides of multiple sheets of paper in order to establish a petal profile along the width of the sheets. Application of the powdered toner to the TAB petals is effected by actuating the TAB petals directly onto a developed solid image on a photoreceptor belt with no paper between the TAB blade and image by readjusting the TAB liftoff timing. The petals pick up an even amount of toner (in contrast to conventional manual toner application techniques) and deposit it on the backside of the next sheet to move through the transfer area. This process is iterated until the desired numbers of samples are produced.

TAB petal pressure against the paper can vary for a variety of reasons including the nature of the petals acting against the moving pages verses the adjacent unmoving fulcrum, the distance the petals have to travel (i.e., a "transfer gap"), the type of paper media being used, the condition (wear) of the TAB and so on. The subtleties of pressure gradients along the TAB as it presses against the width of the paper can produce various image artifacts and defects along the width and length of the document. Capturing a petal pressure profile of the TAB thus involves automatically applying powdered toner material onto the TAB petals while the machine is printing and allowing the toner material to be transferred from the TAB Petals to the backside of multiple sheets of paper, in order to establish a petal profile along the width of the sheets.

The herein-described innovation(s) facilitate uniformly and automatically applying a marking material to the TAB petals and transferring the marking material deposited onto the TAB petals to a sheet of paper, which facilitates diagnosing pressure uniformity across the width of the TAB Blade as well as diagnosing pressure uniformity across the width of the Paper. The described features improve accuracy of the TAB pressure profiled by providing a larger number of TAB profile samples than previously possible without tedious manual reapplication of toner to the TAB petals. Additionally, the profile samples are fused to the pages. Moreover, the described systems and methods improve the rapidity with which a technician can diagnose TAB calibration problems by mitigating the manual toner application step of conventional methods.

Figure 1:
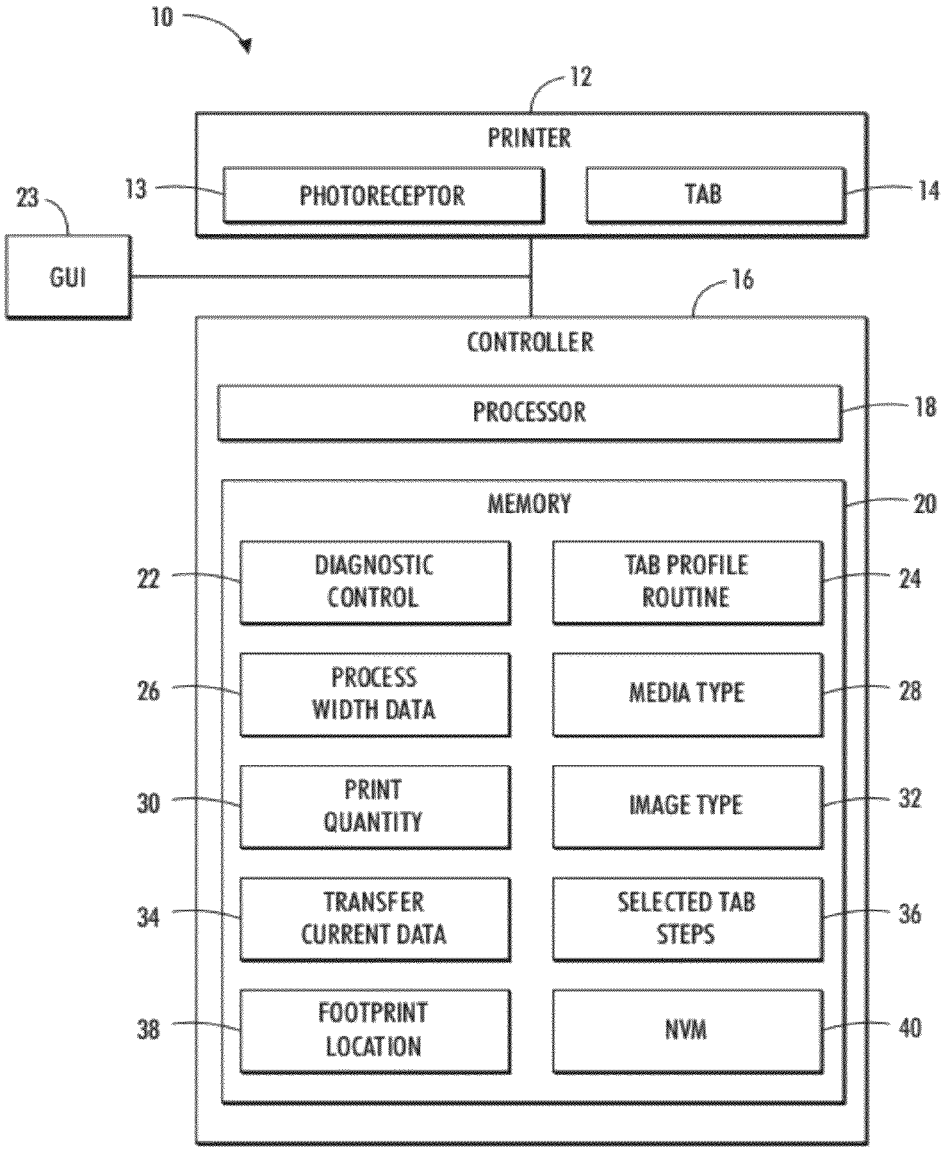
FIG. 1 illustrates a system that facilitates determining transfer assist blade pressure uniformity by automatically applying powdered toner material onto the TAB blade petals during printer operation.

FIG. 1 illustrates a system 10 that facilitates determining transfer assist blade (TAB) pressure uniformity by automatically applying powdered toner material onto the TAB blade petals during printer operation. The system 10 includes a printer 12 with a photoreceptor 13 and a TAB module or assembly 14. The printer 12 is coupled to a controller 16 that includes a processor 18 that executes, and a memory 20 (e.g., a computer readable medium) that stores, computer executable instructions (e.g., executables, routines, programs, algorithms, etc.) for performing the various tasks, functions, routines, procedures, etc., described herein. For instance, the memory 20 stores a diagnostic control program 22 that, when executed by the processor 18, presents an interface to a user via a graphical user interface 23. The user enters TAB pressure profile or footprint generation information into the GUI 23 (e.g., via a keyboard, mouse, stylus, microphone, touchscreen, directional pad, or some other suitable input device(s)) in order to program an automated TAB pressure profile generation routine 24, which is executed by the printer 12.

For instance, the controller 16 receives an indication that the user has selected (clicked on, etc.) a TAB footprint icon or the like on the GUI, and the processor 18 displays on the GUI 23 a TAB footprint control screen that is provided by the diagnostic control program 22. The processor 18 receives, and the memory 20 stores, a user-entered process width value 26 (e.g., 10 inches, 14 inches, or some other predetermined selectable width) for the automated TAB pressure profile generation routine 24. The processor 18 receives, and the memory 20 stores, user-entered media type information 28 and relevant parameters (e.g., paper type, thickness, ambient humidity information, ambient temperature, etc.). Additionally, the processor 18 receives, and the memory 20 stores, a user-entered print quantity 30 for the footprint (e.g., 3 prints, 5 prints, 10 prints, etc.).

Desired image type information 32 is also received by the process and stored in the memory. For instance, the user may select a first image type that is a full-page halftone (FPHT) image type (i.e., a full print), a second image type that includes halftone print in the toner pickup area and a TAB petal pattern or mapping in the remainder of the sheet (i.e., a partial print with a mapping), or a third image type that includes halftone print in the toner pickup area only while the remainder of the sheet is unprinted (i.e., a partial print).

The processor 18 receives, and the memory 20 stores, a user-entered image transfer current value. For instance, the user may select a nominal current or a nominal current +/− a discrete current value (e.g., 20 μA or the like). The processor 18 receives, and the memory 20 stores, a user-entered number of TAB steps indicating a number of steps (e.g., 14, 17, 20, or some other number) of a stepper motor that applies pressure to the TAB, wherein a higher number of steps results in a higher pressure. In one example, the user selects anywhere between 1 and 180 steps. The processor 18 receives, and the memory 20 stores, a user-entered footprint location 38 (e.g., lead edge, opposite non-printed area or region, opposite printed region, center of the page, etc.). At this point, the automated TAB petal pressure profile generation routine has been set up (i.e., relevant parameters have been entered or set, and the routine is ready to be executed).

Upon receiving an instruction to initiate the TAB profile generation routine, the controller 16 generates a print job or task and sends related commands to the printer 12, which executes the print job to generate the TAB pressure profile. During execution of the print job, the TAB liftoff timing is adjusted (see, e.g., FIG. 3 and related description) and/or the page position on the photoreceptor belt is adjusted (see, e.g., FIG. 4 and related description) to cause the TAB petals to automatically pick up toner in an inter-document zone (i.e., between pages) without requiring manual dusting of the TAB petals by a user (e.g., a technician). In either case, the adjustment to TAB liftoff time or page position is effected by changing a corresponding value stored in corresponding non-volatile memory (NVM) 40 locations. That is, to adjust TAB liftoff timing, a value stored in a NVM location that governs TAB liftoff is changed. To adjust page position, a value stored in a NVM location that governs page position is changed Output pressure profile sheets are then analyzed by the user to identify any TAB adjustments or calibrations that may be desired. The TAB is then calibrated appropriately.

As stated above, the controller 16 comprises the processor 18 that executes, and the memory 20 that stores, one or more computer-executable routines (e.g., programs, computer-executable instructions, etc.) for performing the various functions, methods, procedures, etc., described herein. Additionally, "routine," as used herein, denotes a set of computer-executable instructions, software code, program, module, or other computer-executable means for performing the described function, or the like, as will be understood by those of skill in the art. Additionally, or alternatively, one or more of the functions described with regard to the modules herein may be performed manually.

The memory may be a computer-readable medium on which a control program is stored, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, RAM, ROM, PROM, EPROM, FLASH-EPROM, variants thereof, other memory chip or cartridge, or any other tangible medium from which the processor can read and execute. In this context, the systems described herein may be implemented on or as one or more general purpose computers, special purpose computer(s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, Graphical card CPU (GPU), or PAL, or the like.

The TAB device 14 is used to push paper sheets against the photoreceptor belt at the point of transferring the toner image to the paper. With the use of electrostatics, the developed image moves to the paper to be thermally fused on to the paper downstream in the process path in the printer 12. To facilitate the use of different paper widths, the TAB is segmented into N segments or petals, where N is an integer, such as 40, 43, or some other predetermined number of petals). In one example, the N petals are evenly spaced over a predetermined width or span (e.g., 14 inches, 15, inches, etc.). The petals are all joined together on one side, which is pulled down onto a fulcrum forcing the other end of the petals up against the paper and against the photoreceptor belt (e.g., in a see-saw fashion). The petals are employed to compensate for a fulcrum that adjusts for the paper width in the area where width change would be necessary to prevent the photoreceptor belt from being damaged by direct contact with the TAB. Where width adjustment is not necessary, the fulcrum is solid and unmoving. The TAB is typically actuated against paper and retracted in the Inter-Document Zone (IDZ) so it does not damage the photoreceptor belt. However, in the described embodiments, the TAB remains in gentle contact with the photoreceptor belt beyond the trailing edge of each sheet in order to evenly pick up toner distributed on the belt in the inter-document zone. In this manner, the TAB petals are evenly coated with toner for generating a TAB pressure profile, which improves profile accuracy relative to manual toner application to the petals, which can be uneven.

Figure 2:
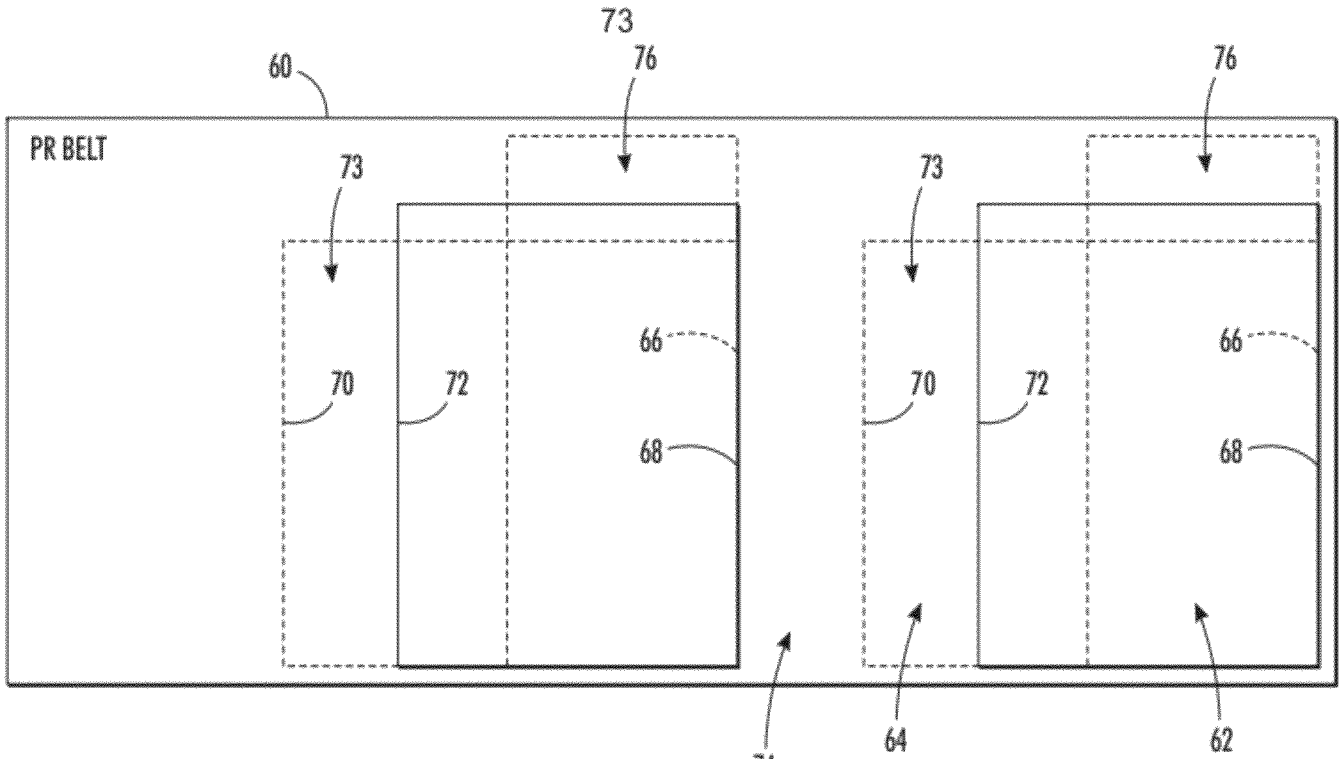
FIG. 2 illustrates a photoreceptor belt against which a TAB is pressed as sheets or pages move past the TAB.

FIG. 2 illustrates a photoreceptor belt 60 against which a TAB (not shown) is pressed as sheets or pages 62 move past the TAB. Toner is automatically applied to the TAB petals (see FIG. 8) by printing an image 64 that is larger than the sheet of paper on which the image is being printed. That is, a leading edge 66 of the page 62 is aligned with an image leading edge 68, while an image trailing edge 70 is further along the photoreceptor belt than a page trailing edge 72. The TAB touches down (i.e., applies pressure) at the leading edge of the page/image and remains engaged until the image trailing edge. When the trailing edge 72 of the page 62 passes the TAB, the TAB petals enter a toner pickup area 73, begin to pick up toner, and continue to do so until the image trailing edge 70 passes the TAB, at which time the TAB lifts off the photoreceptor belt 60. The TAB remains disengaged while an interdocument zone (IDZ) 74 on the photoreceptor belt passes, at the end of which the toner-laden TAB touches down at the leading edge of a new page 62 and oversized image 64. When the TAB touches down on the next sheet to assist transfer, the toner on the TAB petals is deposited onto the back side of the page 62, leaving a visible profile of how the petals are acting upon the paper. Because the toner application is automated and toner is applied evenly across the petals (as opposed to conventional manual toner application, which is typically not uniform), TAB pressure profile accuracy is improved.

According to another aspect, a reference image 76 is provided that extends in the cross-process direction beyond the pages and is shorter than the pages in the process direction. TAB petals that contact the page in the reference image only (and not in the oversized image region) will not pick up toner. In one example, the pages 62 are 12×13 inches (i.e., 12 inches in the process direction, 13 inches in the cross-process direction), the oversized images 64 are 17×11 inches (i.e., 17 inches in the process direction, 11 inches in the cross-process direction), and the reference region is 8.5×14 inches (i.e., 8.5 inches in the process direction, 14 inches in the cross-process direction). In this example, the user would input or select a process width value equal to or greater than the largest cross-process dimension of the pages, oversized images, and/or the reference region (e.g., 14 inches in this example) using the GUI 23 of FIG. 1.

Figure 3:
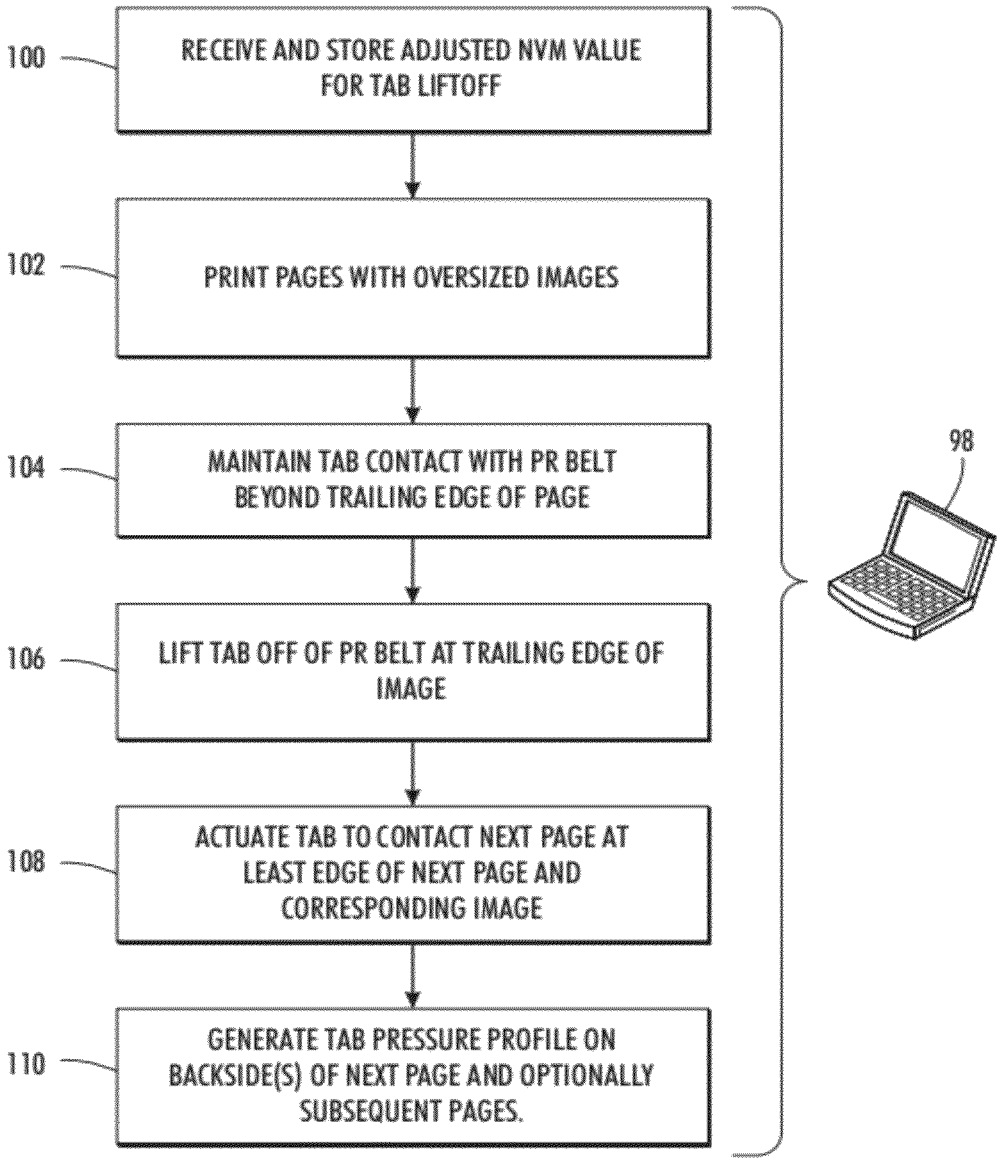
FIG. 3 illustrates a method for adding a trail edge delay to the TAB timing so that TAB liftoff is delayed beyond the trailing edge of the page(s).
Figure 4:
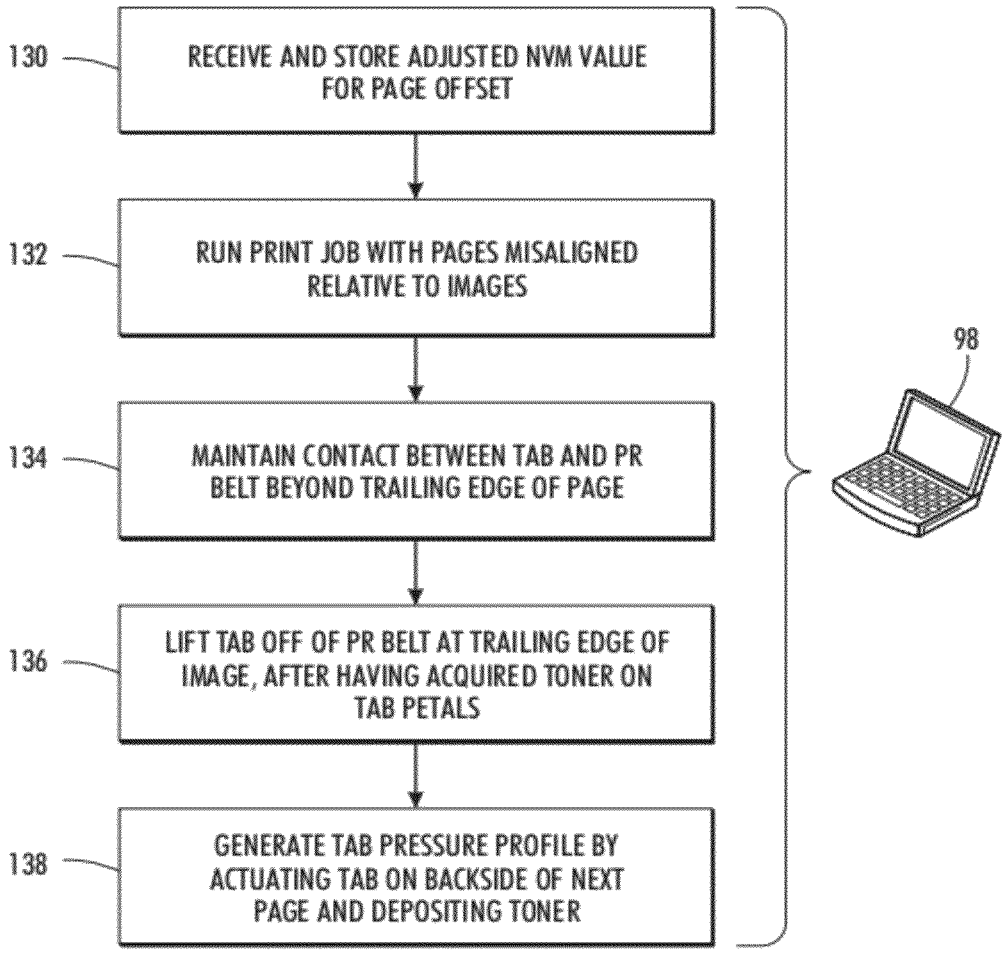
FIG. 4 illustrates a method for shifting page position on the so that the process control toner patches laid down on the photoreceptor belt in between images being printed will be printed onto the paper.

FIGS. 3 and 4 illustrate methods that can be employed to generate the TAB pressure profile as described with regard to FIGS. 1 and 2. Normally, the TAB is only actuated against the paper and is retracted in the IDZ, where process control patches are typically laid down. The methods of FIGS. 3 and 4 involve printing an image larger than the sheet of paper on which the image is printed, causing an area of developed toner on the photoreceptor belt where the TAB petals come in contact with the toner. This is achieved by adjusting TAB liftoff timing, coating the photoreceptor belt with toner, and then depositing that toner on the back of the next page. It will be appreciated that the methods described herein can be implemented on a computer 98 or the like), described in greater detail below.

Accordingly, FIG. 3 illustrates a method for adding a trail edge delay to the TAB timing so that TAB liftoff is delayed beyond the trailing edge of the page(s). At 100, a trail edge delay timing value is adjusted in non-volatile memory (NVM) (i.e., a value that denotes trail edge delay for the TAB liftoff is changed at a particular NVM location) and saved, so that instead of the TAB Blade lifting off from the page at the trail edge of the page, it remains actuated and drags past the trail edge of the sheet and into the area of toner pick up that results from running an oversized image that is larger (in the process direction) than the paper on which it is being printed on (see FIG. 2). At 102, a series of pages are printed with the described oversized images. At 104, for each page, the TAB stays in contact with the photoreceptor belt with toner deposited thereon beyond the trail edge of the page. At 106, the TAB lifts off of the area of toner pick up, bringing toner with it. At 108, at the lead edge of a subsequent page, the TAB touches down again, leaving a profile on the back side of the sheet. The method may be iterated until a desired number of sheets are acquired. At 110, a TAB pressure profile is generated, which is used to adjust TAB pressure if needed. One benefit of this method is that a profile is acquired for TAB adjustment. Additionally, the leading edge touchdown location of the TAB can be determined, which information can be used for TAB adjustment.

FIG. 4 illustrates a method for shifting page position on the photoreceptor so that the process control toner patches that are laid down on the photoreceptor belt in between images being printed (inter document zone or IDZ) will be printed onto the paper. At 130, a non-volatile memory value that denotes the timing offset placing pages on the photoreceptor belt is adjusted and saved at its NVM location. The adjusted value causes a shift in the position of the paper sheets on the photoreceptor belt, which can be viewed as a shift in TAB touchdown and liftoff relative to the pages and the photoreceptor belt. At 132, a print job is run in which the pages are misaligned to the images to be printed thereon, causing the TAB to engage, and to remain engaged after the trailing edge of the page has passed. At 134, the shift in TAB timing (page position) causes the TAB petals to drag through the toner pick up area that results from running an oversized image that is larger than the paper on which it is printed (see FIG. 2). At 136, the TAB lifts off of the area of toner pick up, bringing toner with it, and touches down again onto the next sheet leaving a pressure profile on the sheet. At 138, a TAB pressure profile is generated, which is used to adjust TAB pressure if needed. The TAB footprint or profile is marked on respective sheets away from the leading edge of the sheets and further toward the center of the paper for better viewing. Additionally, the process control patches are printed on the front side of the sheets to facilitate assessing TAB contamination issues during run mode (i.e. by matching a dirt pattern to a patch location), if there are any.

The foregoing techniques can be employed to generate TAB petal pressure profiles that are used to recalibrate the TAB in order to correct for defects that can occur when the TAB is misaligned. For instance, an area between the solid and adjustable fulcrum (lifters) of a TAB assembly can cause an image quality defect known as a "step streak," due to a misalignment between the solid and adjustable lifters. These misalignments can also cause problems when very lightweight paper is run and/or can result in a different image defect called a deletion. In either case, capturing a TAB petal pressure profile across the width of the sheet facilitates correctly diagnosing the root cause of the problem.

Figure 5:
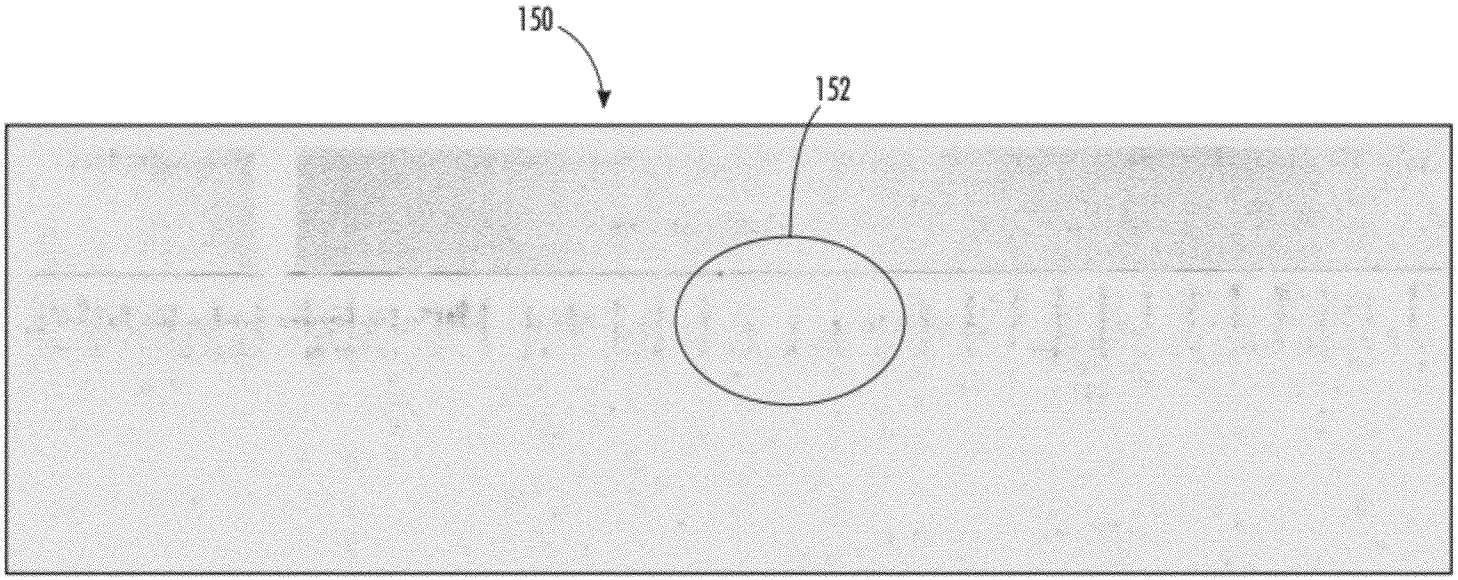
FIG. 5 shows a TAB petal profile in which a non-uniform region has been identified.

FIG. 5 shows a TAB petal profile 150 in which a non-uniform region 152 has been identified using the method of FIG. 3. The non-uniformity 152, in this example, is a deletion that results from an insufficient amount of pressure applied by the TAB petals in the identified region.

Figure 6:
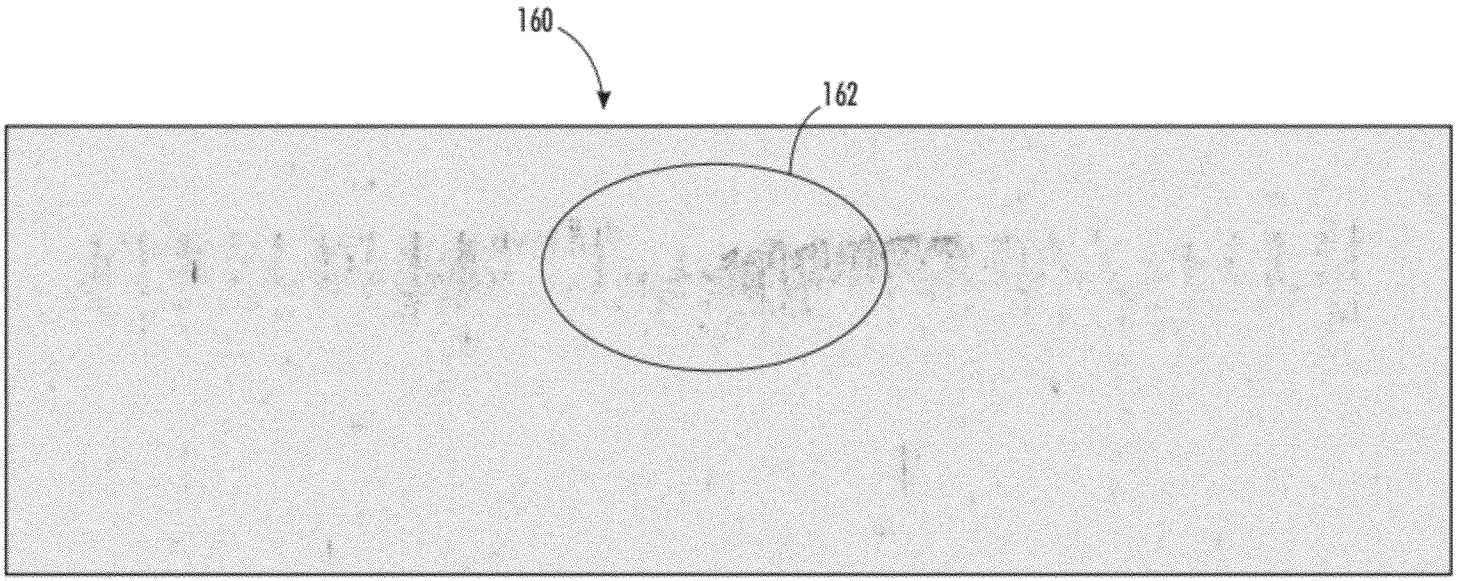
FIG. 6 shows a TAB petal profile in which a non-uniform region has been identified.

FIG. 6 shows a TAB petal profile 160 in which a non-uniform region 162 has been identified using the method of FIG. 4. The non-uniformity 162, in this example, is a step streak that results from misalignment between the solid and adjustable lifters in the TAB assembly.

It will be appreciated that other methods of adjusting the TAB Blade timing are also possible. Such methods, including those described with regard to FIGS. 3 and 4, can be automated for faster diagnosis, error mitigation, and/or to facilitate use by non technical operators in their own diagnoses. An example of an automated flow chart is show below in FIG. 7.

Figure 7:
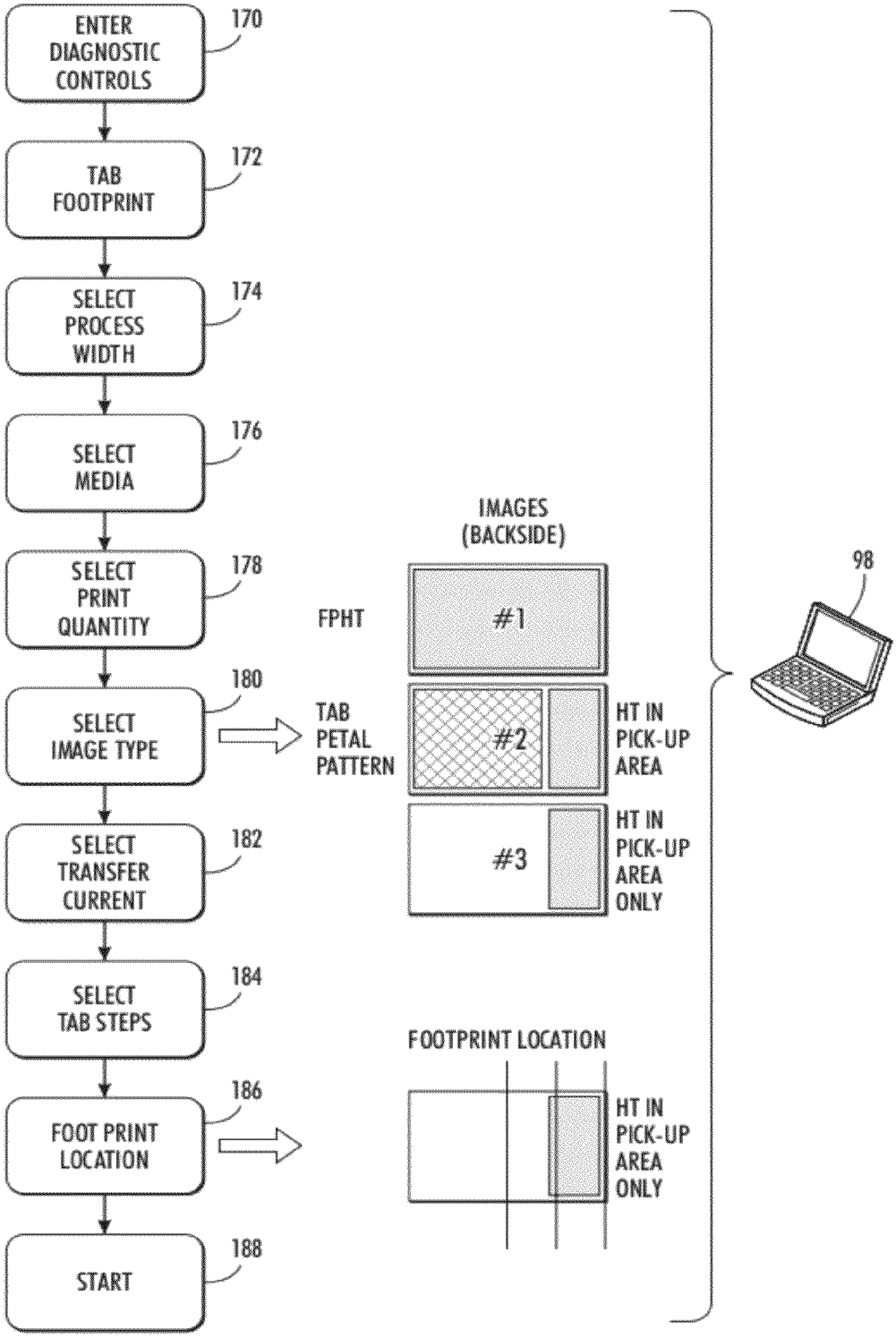
FIG. 7 illustrates a method for setting up a TAB petal pressure profile or footprint generation procedure without requiring manual application of toner to the TAB petals, in which a user interacts with a graphical user interface to set up the automated footprint generation procedure, which is then automatically executed by a print engine.

FIG. 7 illustrates a method for setting up a TAB petal pressure profile or footprint generation procedure without requiring manual application of toner to the TAB petals, in which a user interacts with a graphical user interface (e.g., the GUI 23 of FIG. 1) to set up the automated footprint generation procedure, which is then automatically executed by a print engine. At 170, the user enters a diagnostic control application or program via the GUI. At 172, the user selects (e.g., clicks on or otherwise selects) a TAB footprint icon or the like to bring up a TAB footprint control screen. At 174, the user selects or enters a process width (e.g., 10 inches, 14 inches, or some other predetermined selectable width) for the automated TAB footprint generation procedure. At 176, the user enters or selects media type information and relevant parameters (e.g., paper type, thickness, ambient humidity information, ambient temperature, etc.). At 178, the user indicates or selects a number of prints desired for the footprint (e.g., 5 prints, 20 prints, etc.).

At 180, the user selects or enters a desired image type. For instance, the user may select a first image type that is a full-page halftone (FPHT) image type (i.e., a full print), a second image type that includes halftone print in the toner pickup area and a TAB petal pattern or mapping in the remainder of the sheet (i.e., a partial print with a mapping), or a third image type that includes halftone print in the toner pickup area only while the remainder of the sheet is unprinted (i.e., a partial print).

At 182, the user selects or enters an image transfer current. For instance, the user may select a nominal current or a nominal current +/−a discrete current value (e.g., 20 μA or the like). At 184, the user selects or enters a number of TAB steps indicating a number of steps (e.g., 14, 17, 20, or some other number) of a stepper motor that applies pressure to the TAB, wherein a higher number of steps results in a higher pressure. In one example, the user selects anywhere between 1 and 180 steps. At 186, the user enters or selects or enters a desired footprint location (e.g., lead edge, opposite non-printed area or region, opposite printed region, center of the page, etc.). At 188, the automated TAB petal pressure profile generation procedure has been set up, and the user starts the procedure, which is then automatically executed by the printer. Output pressure profile sheets are then analyzed by the user to identify any TAB adjustments or calibrations that may be desired.

Figure 8:
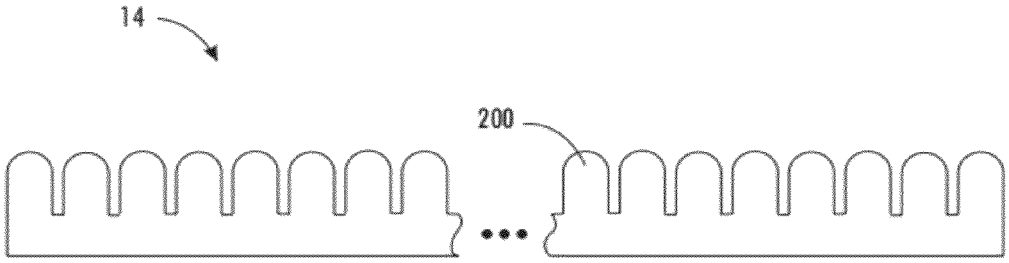
FIG. 8 illustrates a TAB such as may be employed in conjunction with the various aspects described herein.

FIG. 8 illustrates a TAB 14 such as may be employed in conjunction with the various aspects described herein. The TAB 14 includes a plurality of petals 200 that, when the TAB is actuated, apply pressure to sheets of paper as they pass by the TAB while having an image fused thereon by a charged photoreceptor belt.

The described systems and methods may be performed by or included in a computer program product that may be executed on a computer 98 (FIGS. 3, 4, and 7) or computing device, which may be separate from or integral to the printer 12 and/or the controller 16 of FIG. 1. Further, it is to be appreciated that any suitable computing environment can be employed in accordance with the present embodiments. For example, computing architectures including, but not limited to, stand alone, multiprocessor, distributed, client/server, minicomputer, mainframe, supercomputer, digital and analog can be employed in accordance with the present embodiments.

The computer can include a processing unit such as the processor 18 of FIG. 1, a system memory such as the memory 20 of FIG. 1, and a system bus that couples various system components including the system memory to the processing unit. The processing unit can be any of various commercially available processors (e.g., a central processing unit, a graphical processing unit, etc.). Dual microprocessors and other multi-processor architectures also can be used as the processing unit.

The system bus can be any of several types of bus structure including a memory bus or memory controller, a peripheral bus, and a local bus using any of a variety of commercially available bus architectures. The computer memory includes read only memory (ROM) and random access memory (RAM). A basic input/output system (BIOS), containing the basic routines that help to transfer information between elements within the computer, such as during start-up, is stored in ROM.

The computer can further include a hard disk drive, a magnetic disk drive, e.g., to read from or write to a removable disk, and an optical disk drive, e.g., for reading a CD-ROM disk or to read from or write to other optical media. The computer typically includes at least some form of computer readable media. Computer readable media can be any available media that can be accessed by the computer. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other magnetic storage devices, or any other medium which can be used to store the desired information and which can be accessed by the computer.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above can also be included within the scope of computer readable media.

A number of program modules may be stored in the drives and RAM, including an operating system, one or more application programs, other program modules, and program non-interrupt data. The operating system in the computer can be any of a number of commercially available operating systems.

A user may enter commands and information into the computer through a keyboard (not shown) and a pointing device or stylus (not shown), such as a mouse. Other input devices (not shown) may include a microphone, an IR remote control, a joystick, a game pad, a satellite dish, a scanner, or the like. These and other input devices are often connected to the processing unit through a serial port interface (not shown) that is coupled to the system bus, but may be connected by other interfaces, such as a parallel port, a game port, a universal serial bus (USB), an IR interface, etc.

A monitor (not shown), or other type of display device, may also be connected to the system bus via an interface, such as a video adapter (not shown). In addition to the monitor, a computer typically includes other peripheral output devices (not shown), such as speakers, printers etc. The monitor can be employed with the computer to present data that is electronically received from one or more disparate sources. For example, the monitor can be an LCD, plasma, CRT, etc. type that presents data electronically. Alternatively or in addition, the monitor can display received data in a hard copy format such as a printer, facsimile, plotter etc. The monitor can present data in any color and can receive data from the computer via any wireless or hard wire protocol and/or standard.

The computer can operate in a networked environment using logical and/or physical connections to one or more remote computers, such as a remote computer(s). The remote computer(s) can be a workstation, a server computer, a router, a personal computer, microprocessor based entertainment appliance, a peer device or other common network node, and typically includes many or all of the elements described relative to the computer. The logical connections depicted include a local area network (LAN) and a wide area network (WAN). Such networking environments are commonplace in offices, enterprise-wide computer networks, intranets and the Internet.

When used in a LAN networking environment, the computer is connected to the local network through a network interface or adapter. When used in a WAN networking environment, the computer typically includes a modem, or is connected to a communications server on the LAN, or has other means for establishing communications over the WAN, such as the Internet. In a networked environment, program modules depicted relative to the computer, or portions thereof, may be stored in the remote memory storage device. It will be appreciated that network connections described herein are exemplary and other means of establishing a communications link between the computers may be used.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A method of automating generation of a transfer assist blade (TAB) pressure profile, comprising:

receiving TAB profile generation parameters, the parameters comprising information relating to automatically and uniformly applying toner to a plurality of TAB petals;

printing an oversized image on a plurality of pages to generate at least one toner pickup area on a photoreceptor belt in a printing device;

maintaining contact between the TAB petals and the photoreceptor belt beyond a trailing edge of at least a first page, thereby uniformly acquiring toner on the TAB petals;

disengaging the TAB petals from the photoreceptor belt at a trailing edge of the oversized image;

generating the TAB pressure profile by re-engaging the TAB petals and depositing the uniformly acquired toner on at least a second page as it passes by the TAB; and outputting at least one printed page having the TAB pressure profile deposited thereon;

wherein the TAB profile generation parameters comprise a selected number of TAB steps that correspond to an amount of pressure applied by the TAB to the pages as they pass the TAB during TAB pressure profile generation.

2. The method according to claim 1, further comprising:

calibrating the TAB as a function of the TAB pressure profile.

3. The method according to claim 1, wherein the TAB profile generation parameters comprise a process width value that is indicative of a cross-process width that is equal to or greater than the largest cross-process dimension of the pages, oversized image, and/or a reference region on the photoreceptor belt.

4. The method according to claim 1, wherein the TAB profile generation parameters comprise media type information indicative of a type of paper on which the oversized image is printed.

5. The method according to claim 1, wherein the TAB profile generation parameters comprise a number of pages on which TAB profiles are generated.

6. The method according to claim 1, wherein the TAB profile generation parameters comprise a selected image type comprising one of:

a full print halftone image;

a partial print halftone image; and a partial print halftone image with a TAB petal pattern mapping that is compared to the generated TAB pressure profile.

7. The method according to claim 1, wherein the TAB profile generation parameters comprise a selected transfer current that is applied to the photoreceptor belt to fuse the toner to the pages.

8. The method according to claim 1, wherein the TAB profile generation parameters comprise a selected location at which acquired toner is deposited by the TAB petals on a backside of each page for TAB pressure profile generation.

9. The method according to claim 1, wherein maintaining contact between the TAB petals and the photoreceptor belt beyond a trailing edge of at least a first page comprises adjusting a non-volatile memory (NVM) value that controls TAB liftoff timing, thereby causing the TAB to remain engaged after the trailing edge of the at least first page has passed the TAB.

10. The method according to claim 1, wherein maintaining contact between the TAB petals and the photoreceptor belt beyond a trailing edge of at least a first page comprises adjusting a non-volatile memory (NVM) value that controls page position on the photoreceptor belt, thereby causing the TAB to remain engaged after the trailing edge of the at least first page has passed the TAB.

11. A system that facilitates automating generation of a transfer assist blade (TAB) pressure profile, comprising:

a printer that comprises a photoreceptor belt and a TAB; and a processor that executes stored computer-executable instructions for:

receiving TAB profile generation parameters, the parameters comprising information relating to automatically and uniformly applying toner to a plurality of TAB petals;

printing an oversized image on a plurality of pages to generate at least one toner pickup area on a photoreceptor belt in a printing device;

maintaining contact between the TAB petals and the photoreceptor belt beyond a trailing edge of at least a first page, thereby uniformly acquiring toner on the TAB petals;

disengaging the TAB petals from the photoreceptor belt at a trailing edge of the oversized image; and generating the TAB pressure profile by re-engaging the TAB petals and depositing the uniformly acquired toner on at least a second page as it passes by the TAB;

wherein the printer prints the oversized image on the plurality of pages and outputs the plurality of pages with the TAB pressure profile deposited on a backside of at least one of the plurality of pages; and wherein the TAB profile generation parameters comprise a selected image type comprising one of:

a full print halftone image;

a partial print halftone image; and a partial print halftone image with a TAB petal pattern mapping that is compared to the generated TAB pressure profile.

12. The system according to claim 11, the instructions further comprising:

calibrating the TAB as a function of the TAB pressure profile.

13. The system according to claim 11, wherein the TAB profile generation parameters comprise a process width value that is indicative of a cross-process width that is equal to or greater than the largest cross-process dimension of the pages, oversized image, and/or a reference region on the photoreceptor belt.

14. The system according to claim 11, wherein the TAB profile generation parameters comprise at least one of:

media type information indicative of a type of paper on which the oversized image is printed; and a number of pages on which TAB profiles are generated.

15. The system according to claim 11, wherein the TAB profile generation parameters comprise at, least one of:

a selected transfer current that is applied to the photoreceptor belt to fuse the toner to the pages;

a selected number of TAB steps that correspond to a an amount of pressure applied by the TAB to the pages as they pass the TAB during TAB pressure profile generation; and a selected location at which acquired toner is deposited by the TAB petals on a backside of each page for TAB pressure profile generation.

16. The system according to claim 11, wherein the instructions for maintaining contact between the TAB petals and the photoreceptor belt beyond a trailing edge of at least a first page comprise instructions for adjusting a non-volatile memory (NVM) value that controls TAB liftoff timing, thereby causing the TAB to remain engaged after the trailing edge of the at least first page has passed the TAB.

17. The system according to claim 11, wherein the instructions for maintaining contact between the TAB petals and the photoreceptor belt beyond a trailing edge of at least a first page comprise instructions for adjusting a non-volatile memory (NVM) value that controls page position on the photoreceptor belt, thereby causing the TAB to remain engaged after the trailing edge of the at least first page has passed the TAB.

18. The system according to claim 11, further comprising a graphical user interface (GUI) via which a user enters TAB profile generation parameter settings and on which information is presented to the user.

19. A method of automating generation of a transfer assist blade (TAB) pressure profile, comprising:

printing an oversized image on a plurality of pages to generate at least one toner pickup area on a photoreceptor belt in a printing device;

altering a TAB liftoff timing value in a non-volatile memory (NVM) location in which the value is stored to cause petals of the TAB to maintain contact between the photoreceptor belt beyond a trailing edge of at least a first page, thereby uniformly acquiring toner on the TAB petals;

disengaging the TAB petals from the photoreceptor belt at a trailing edge of the oversized image;

re-engaging the TAB on at least a second page and depositing the uniformly acquired toner on at least a second page as it passes by the TAB; and outputting at least one printed page having the TAB pressure profile deposited thereon;

wherein the TAB profile generation parameters comprise a selected transfer current that is applied to the photoreceptor belt to fuse the toner to the pages.

* * * * *